US005281087A

United States Patent [19]

Hines

[11] Patent Number: 5,281,087

[45] Date of Patent: Jan. 25, 1994

[54] INDUSTRIAL GAS TURBINE ENGINE WITH DUAL PANEL VARIABLE VANE ASSEMBLY

[75] Inventor: William R. Hines, Cincinnati, Ohio

[73] Assignee: General Electric Company, Cincinnati, Ohio

[21] Appl. No.: 896,640 .

[22] Filed: Jun. 10, 1992

[51] Int. Cl.[5] ..... F04D 29/56

[52] U.S. Cl. ..... 415/160

[58] Field of Search ..... 415/160, 161, 162

[56] References Cited

U.S. PATENT DOCUMENTS

| | | | |
|---|---|---|---|
| 2,527,732 | 10/1950 | Imbert . | |
| 2,723,518 | 12/1955 | Wilde et al. | 415/161 |
| 2,858,062 | 10/1958 | Allen . | |
| 2,933,235 | 4/1960 | Neumann . | |
| 3,108,767 | 10/1963 | Eltis et al. . | |
| 3,999,883 | 12/1976 | Nordenson . | |
| 4,060,980 | 12/1977 | Elsaesser et al. . | |
| 4,068,471 | 1/1978 | Simmons . | |
| 4,175,382 | 11/1979 | Pfenninger . | |
| 4,254,619 | 3/1981 | Giffen et al. | 60/226 |
| 4,257,734 | 3/1981 | Guy et al. . | |
| 4,446,696 | 5/1984 | Sargisson et al. | 60/226.3 |
| 4,498,790 | 2/1985 | Fisher . | |
| 4,709,546 | 12/1987 | Weller . | |
| 4,986,305 | 1/1991 | Richards et al. . | |
| 4,990,056 | 2/1991 | McClain et al. . | |
| 4,995,786 | 2/1991 | Wheeler et al. . | |
| 5,061,152 | 10/1991 | Marey . | |

FOREIGN PATENT DOCUMENTS

| | | | |
|---|---|---|---|
| 185700 | 8/1986 | Japan | 415/160 |
| 702265 | 1/1954 | United Kingdom | 415/161 |

*Primary Examiner*—Louis J. Casaregola

*Attorney, Agent, or Firm*—Jerome C. Squillaro; James P. Davidson

[57] ABSTRACT

An industrial gas turbine engine includes in serial flow relationship a booster compressor, a core engine, a power turbine having a first shaft joined to the booster and an output shaft, and means for independently varying the radially outer and radially inner booster flow areas. The means for independently varying the radially inner and outer booster flow areas can include a dual panel variable booster inlet guide vane assembly having first and second variable vane portions. The vane assembly can include a first variable vane portion rotatably supported with a first vane panel extending in a cantilevered manner adjacent a second vane panel to provide a closely spaced radial clearance therebetween. Varying means can be positioned outward of a casing for independently varying the first and second vane portions. The variable vane assembly can be operable with compressor bleed means or power turbine outlet area varying means. In one embodiment the variable vane assembly can provide a minimum horsepower from the output shaft during unfueled shutdowns or for allowing lock-on and lock-off of an electrical generator at a synchronous speed.

6 Claims, 5 Drawing Sheets

INDUSTRIAL GAS TURBINE ENGINE WITH DUAL PANEL VARIABLE VANE ASSEMBLY

This application incorporates by reference previously filed U.S. Patent application Ser. No. 07/550,271, Gas Turbine Engine and Method of Operation for Controlling Stall Margin.

TECHNICAL FIELD

The present invention relates generally to gas turbine engines, and more specifically to aircraft gas turbine engines adapted for land-based and marine applications having a variable vane assembly for regulating flow in a channel.

BACKGROUND ART

Marine and land-based industrial (M & I) gas turbine engines are frequently derived from engines designed for aircraft because it can be cost effective to develop an M & I engine by modifying an existing aircraft gas turbine engine in the desired power class. One M & I engine application provides output shaft horsepower for powering an electrical generator at a synchronous speed, such as 3000 rpm or 3600 rpm for generating electricity at 50 Hz or 60 Hz. To keep development costs and kilowatt-hour costs low, M & I engine designers typically use a parent aircraft engine and make as few changes in the parent engine as needed for obtaining the desired land-based M & I engine.

One type of M & I engine used for powering an electrical generator can include two rotors. A first low pressure rotor system can include a power turbine which powers a booster compressor through a first low pressure shaft, and a load, such as an electrical generator, through an output shaft. Power turbine horsepower not required to drive the booster compressor is available as output shaft horsepower to drive the electrical generator. The booster compressor, power turbine, and output shaft are mechanically coupled and rotate together. A second core engine high pressure rotor system includes a conventional high pressure compressor (HPC) driven by a conventional high pressure turbine (HPT) through a second high pressure rotor shaft.

In the parent aircraft engine a reduction in power level setting or fuel flow to the core engine would require a corresponding reduction in speed of the power turbine and booster compressor. This reduction in speed would be necessary to match the flow delivered by the booster compressor to the flow required by the the core engine at the reduced power level. However, in the M & I derivative engine the power turbine and booster compressor must rotate at the constant synchronous speed of the electrical generator at both high and low power settings of the core engine, and regardless of the horsepower required at the output shaft by the electrical generator. The parent engine was initially designed for providing substantial horsepower from the power turbine at the synchronous speed for powering the fan in the parent engine. Thus, at low core power settings the booster compressor in the industrial derivative engine will tend to deliver more airflow than is required to the core engine, which can result in booster compressor stall. This problem can occur, for instance, during lock-on or lock-off of the generator from the electric power grid, or during an emergency unfueled shut-down of the engine.

Single panel variable inlet guide vanes (VIGVS) postioned at the inlet of the booster compressor can be partially closed to reduce booster flow to the compressor and to reduce power turbine horsepower. In addition, variable bleed valves (VBVS) can be used with booster VIGVs to further reduce the amount of booster flow entering the core engine and the power turbine horsepower. Accordingly, the parent aircraft engine could be further modified by replacing the original VBVs with larger VBVs for bleeding additional compressed air from the booster compressor, and the VIGVs could also be modified for closing even further the booster compressor inlet. However, larger VBV's are generally undesirable since they require additional structural changes to the parent engine, and larger VBVs require larger openings that can reduce the stiffness and load bearing capability of load carrying engine structures in which they are formed. In one exemplary engine application, the required flow area of the VBVs in the M & I engine would have to be increased twice as large as the original flow area of the VBVs in the parent aircraft engine for reducing the output shaft horsepower to a substantially zero value for allowing lock-on and lock-off of the generator to the electrical grid. In addition, further closure of conventional single panel VIGVs can result in undesirable pressure and temperature distortions in the compressed airflow channeled to the core engine. Such distortion can result in core compressor stall and possible damage to the core engine.

Thus, engineers and scientists continue to seek improved modifications of parent aircraft engines to obtain industrial gas turbine derivative engines.

SUMMARY OF INVENTION

An industrial gas turbine engine includes in serial flow relationship a booster compressor, a core engine, a power turbine having a first shaft joined to the booster and an output shaft, and means for independently varying the radially outer and radially inner booster flow areas. The means for independently varying the radially inner and outer booster flow areas can include a dual panel variable booster inlet guide vane assembly having first and second variable vane portions. The vane assembly can include a first variable vane portion rotatably supported with a first vane panel extending in a cantilevered manner adjacent a second vane panel to provide a closely spaced radial clearance therebetween. Varying means can be positioned outward of a casing for independently varying the first and second vane portions. The variable vane assembly can be operable with compressor bleed means or power turbine outlet area varying means. In one embodiment the variable vane assembly can provide a minimum horsepower from the output shaft during unfueled shutdowns or for allowing lock-on and lock-off of an electrical generator at a synchronous speed.

BRIEF DESCRIPTION OF DRAWINGS

The novel features of the invention are set forth and differentiated in the claims. The invention is more particularly described in the following detailed description in which:

MODE(S) FOR CARRYING OUT THE INVENTION

Figure 1:
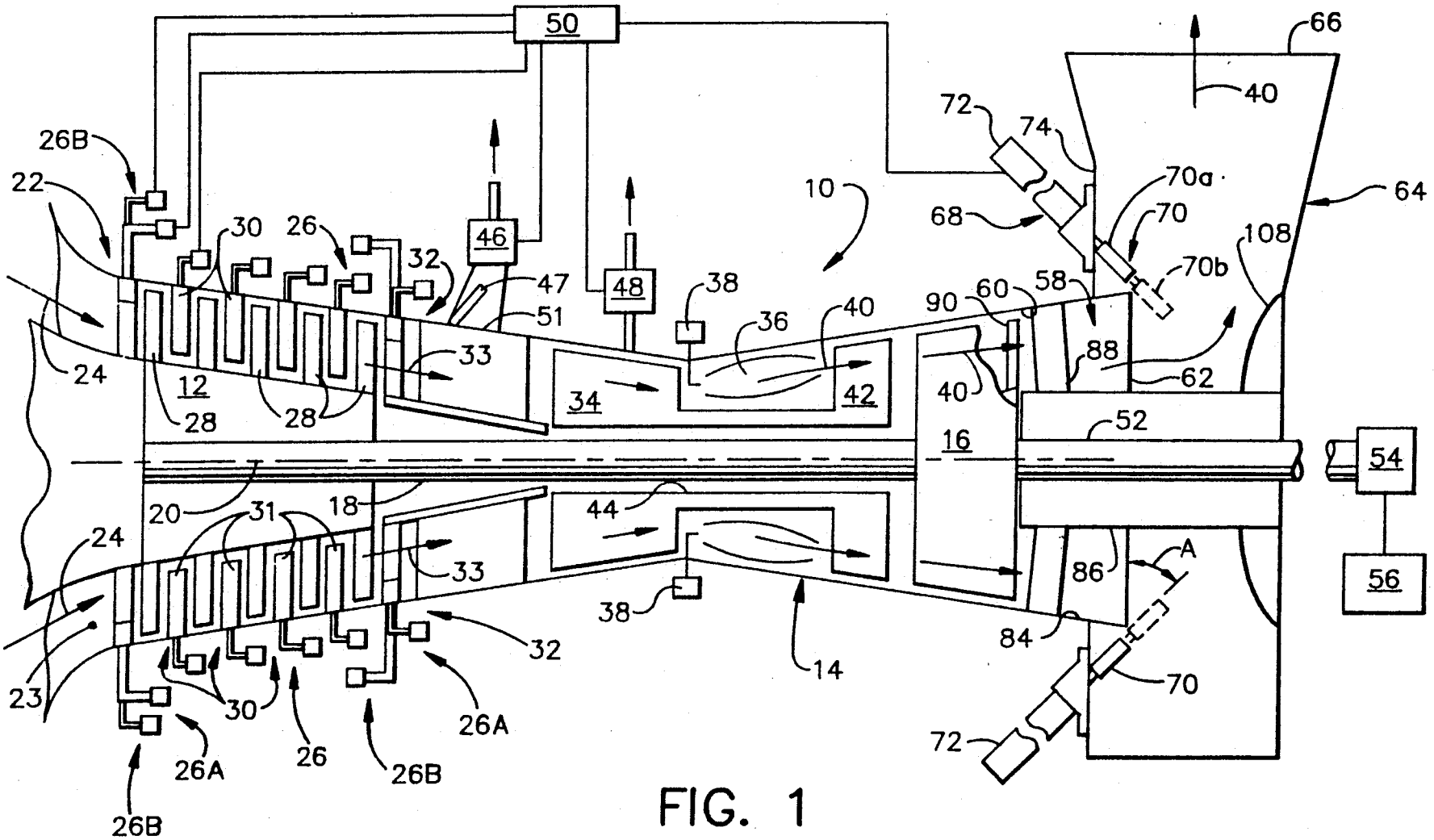
FIG. 1 is a centerline sectional schematic view of a gas turbine engine in accordance with the present invention.

FIG. 1 illustrates an exemplary gas turbine engine 10 in accordance with the present invention wherein engine 10 is derived from a conventional aircraft high bypass turbofan gas turbine engine. Though engine 10 is an aircraft-derived engine, originally designed engines may also be used. Engine 10 includes in serial flow relationship an improved low-pressure, or booster compressor 12 in accordance with the present invention, a core engine 14, and a low-pressure, or power, turbine 16 having a first rotor shaft 18 conventionally joined to the booster compressor 12 for providing power thereto, all disposed coaxially about a longitudinal centerline axis 20.

The booster compressor 12 compresses a booster inlet airflow 24 to provide a compressed booster airflow 33 to the core engine 14. The core engine 14 can include a conventional high-pressure compressor (HPC) 34 which further compresses at least a portion of the compressed booster airflow 33 and channels it to a conventional annular combustor 36. Conventional fuel injection means 38 provides fuel to the combustor 36 wherein it is mixed with the compressed airflow for generating combustion gases 40 which are conventionally channeled to a conventional high-pressure turbine (HPT) 42. The HPT 42 is conventionally joined to the HPC 34 by a second rotor shaft 44.

The engine 10 can include an output shaft 52 extending downstream from the power turbine 16, in a direction opposite to that of the first shaft 18, which output shaft 52 is directly connected to a conventional electrical generator 54. Alternatively, shaft 52 could extend upstream from booster 12 for connection to a generator forward of engine 10. The generator 54 is conventionally joined to an electrical power grid indicated schematically at 56.

The power turbine 16 extracts power from the combustion gases 40 channeled thereto from HPT 42 for rotating the booster compressor 12 through shaft 18 and for providing output power to the generator 54 as horsepower through output shaft 52.

The engine 10 can further include a flow channel or diffuser 58 having an inlet 60 disposed for receiving combustion gases 40 channeled through power turbine 16. The diffuser 58 can include an outlet 62 for discharging the combustion gases 40 into an exhaust assembly 64. The exhaust assembly 64 includes a discharge 66 for discharging gases 40 to the atmosphere. The engine 10 can also include means 68 with positionable flaps 70 and actuator 72 for selectively varying the flow area of outlet 62 for controlling stall margin of the booster compressor 12, as disclosed in previously filed U.S. Pat. application Ser. No. 07/550,271.

Figure 2:
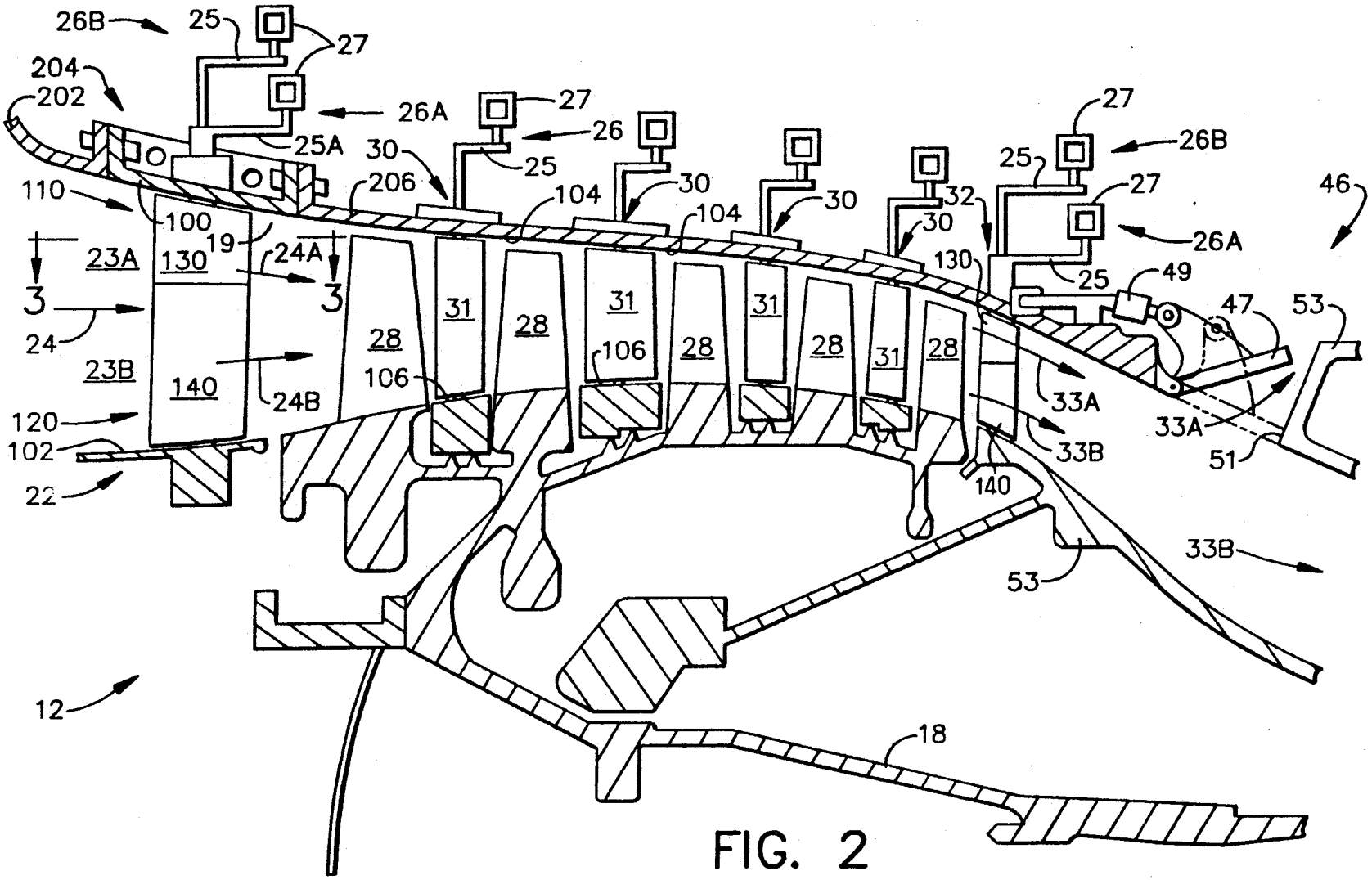
FIG. 2 is an enlarged view of the schematic of FIG. 1.

Referring to FIGS. 1 and 2, the booster compressor 12 includes a plurality of circumferentially spaced rotor blades 28 and stator vanes 30 disposed in several rows, with five rows of blades 28 and four rows of stator vanes 30 being illustrated. Stator vanes 30 direct booster airflow 24 at the desired angle into rotating blades 28. Stator vanes 30 can be conventional variable stator vanes with a single panel 31 for directing booster airflow 24 into rotating blades 28 at various angles depending on engine operating conditions to improve booster stall margin. Stall margin is a conventional parameter which indicates the margin of operation of the booster compressor 12 for avoiding undesirably high pressure ratios across the booster compressor 12 at particular flow rates of the airflow 33 therethrough which would lead to undesirable stall of the booster compressor 12.

Each single panel 31 extends across substantially the entire radial extent of the booster flow 24 from an outer booster flowpath boundary 104 to an inner booster flowpath boundary 106. Stator vanes 30 can include conventional varying means 26 such as crank arms 25 and unison ring assemblies 27 for varying the angle of a single vane panel 31 with respect to booster flow 24. Variable stator vanes and varying means in an HPC are shown in U.S. Pat. No. 4,986,305, which is hereby incorporated by reference.

In accordance with the present invention, the improved booster compressor includes an array of circumferentially spaced apart dual panel variable vane assemblies 22 (only one shown in FIG. 2) which can be positioned upstream of the first row of blades 28 at the booster inlet to provide dual panel variable inlet guide vane assemblies. Each vane assembly 22 is adapted for varying a radially outer booster inlet flow area 23A for regulating a radially outer portion 24A of booster inlet flow 24, and is also adapted for independently varying a radially inner booster inlet flow area 23B for regulating a radially inner portion 24B of booster inlet flow 24. Assembly 22 includes a first variable vane portion 110 with a first vane panel 130 disposed within the booster flow channel 19 adjacent a first radial outer channel wall 100, and a second variable vane portion 120 with a second vane panel 140 disposed within channel 19 adjacent a second channel wall 102 and spaced from the first channel wall 100 by first vane panel 130. Channel walls 100 and 102 can form upstream continuations of booster flowpath boundaries 104 and 106.

Separate varying means 26A and 26B for independently varying first and second variable vane portions 110 and 120, respectively, are both disposed outward of the first channel wall 100 for ease of access and assembly. Each varying means 26A and 26B can include a conventional crank arm 25 connected to a unison ring assembly 27 which are disposed radially outward of channel wall 100. A more detailed description of vane assembly 22 is provided below.

Bleed means 46, such as a plurality of conventional circumferentially spaced booster variable bleed valves (VBVS) 47 and associated openings 51 used in the parent engine, can be provided for bleeding a portion of the compressed airflow 33 upstream of the core engine to increase booster stall margin and to control the amount of compressed airflow channeled to the HPC 34 for matching the operation of booster 12 and core engine 14. The portion of airflow 33 channeled through openings 51 can be ejected from engine 10 or used to cool engine components. The VBVs 47 can be conventionally varied by actuators 49 from a closed position which prevents bleed airflow, to an open position shown in FIG. 2 which provides a maximum amount of bleeding of the compressed booster airflow 33 upstream of the core engine 14. Engine 10 can further include conventional means 48 for bleeding a portion of the compressed airflow 33 at various stages of HPC 34.

The engine 10 can include a conventional control means 50, such as a mechanical or digital electronic control, which can be adapted to control operation of the engine 10 including, for example, operation of the varying means 26, the VBVs 46, the HPC bleed means 48, the exhaust area varying means 68, and the fuel injection means 38.

The parent of the M & I engine 10 was originally designed for powering an aircraft from takeoff through cruise, for example, thus requiring varying output power from the power turbine 16 at varying rotational speeds to drive a fan. However, in adapting the parent engine for powering an electrical generator at a synchronous speed such as 3600 rpm for generating electrical power at 60 Hz, the power turbine 16, booster 12, first shaft 18, and output shaft 52 are operated at a reduced maximum speed (the synchronous speed) relative to the parent engine maximum fan speed. That is, while the core engine will be operated at various speeds and power levels depending upon the electric power generation demand, the power turbine and booster must rotate at an identical constant speed (the synchronous speed) for all output shaft 52 horsepower levels in order to generate electricity at a constant frequency.

Accordingly, to bring generator 54 on line, engine 10 must be operated for increasing the rotational speed of the power turbine 16 and output shaft 52 up to the synchronous speed in order for locking on the generator 54 to the electrical power grid 56. However, since the engine 10 is basically unchanged from the original parent aircraft engine, operation of the power turbine 16 at the synchronous speed would result in a substantial output shaft horsepower from the output shaft 52 but for the present invention. Substantial output shaft horsepower at lock-on is undesirable because the only loading on the shaft 52 prior to lock-on consists of relatively small loads (about 40 to 500 hp in typical embodiments) due to windage and bearing losses of the generator 54. Because output shaft 52 horsepower at the synchronous speed would be substantially larger than this no-load condition without the present invention, the generator cannot be locked on without some manner of clutching, which is undesirable.

Another problem with operating an aircraft-derived M & I engine for generating electricity occurs during lock-off of the generator from the power grid. During such lock-off the generator load on shaft 52 is eliminated, and all available power turbine horsepower is directed to the booster compressor. Since the minimum power turbine horsepower at synchronous speed is greater than that required by the booster compressor in the parent engine, the power turbine and booster compressor would overspeed and stall the booster but for the present invention.

In an exemplary engine 10, full power on-line synchronous operation generates about 56,000 SHP at the output shaft 52 for operating generator 54. One means for reducing horsepower at output shaft 52 in a conventional M & I engine at the off-line synchronous speed would be to bleed a portion of compressed airflow 33 through opened VBVs 47 for reducing the flow rate to the core engine 14. Such bleed airflow reduces the horsepower at shaft 52 in exemplary engine 10 to about 10,500 SHP, which is still too large to allow lock-on of the generator 54. A further conventional means for reducing shaft 52 horsepower includes rotating the single panels 31 of conventional variable stator vanes 30, which can be positioned at the inlet of the booster compressor 12. Single panel 31 can be rotated from a fully open angular orientation of about 0 degrees relative to the inlet airflow 24, to a position having an angular orientation of about 40 degrees closure relative to the inlet airflow 24 for partially reducing the flow area to the booster compressor 12 and partially obstructing the inlet airflow 24. Even with VBVs 47 open and single vane panels 31 rotated to about 40 degrees closed, output shaft 52 horsepower is only reduced to about 6800 SHP in exemplary engine 10. Such output power is still unacceptably high for lock-on of the generator.

Enlarging VBV openings 51 to increase the bleed capacity of VBVs 47 would provide further reduction in the output shaft horsepower, but would reduce the stiffness and load carrying capability of the engine structure 53 in which the openings 51 are located, and could require major structural modifications of the engine. Alternatively, further closure of conventional vane panels 31 could also provide a further reduction in the flow area to the booster 12, but closure of single panels 31 beyond about 40 to 60 degrees can result in unacceptable distortion and temperature rise of the entire airflow 33 entering the core engine 14. Such distortion and temperature rise can result in HPC stall, and possibly damage the core engine.

In accordance with the present invention, the inlet variable vane assemblies 22 may be used for regulating the booster flow 24, and decreasing the aerodynamic efficiency of the booster compressor 12. Variable vane assembly 22 can thereby reduce output shaft 52 horsepower at the synchronous speed for maintaining the synchronous speed for allowing lock-on and lock-off of the generator 54 to the power grid 56. Variable vane assembly 22 can also prevent booster stall by reducing booster flow 24 at low power operation. Variable vane assembly 22 is also operable for obtaining a maximum booster inlet flow area 23 for operating the engine 10 at the maximum horsepower from the output shaft 52, i.e. at the on-line synchronous full power operation at 56,000 SHP.

Figure 3A:
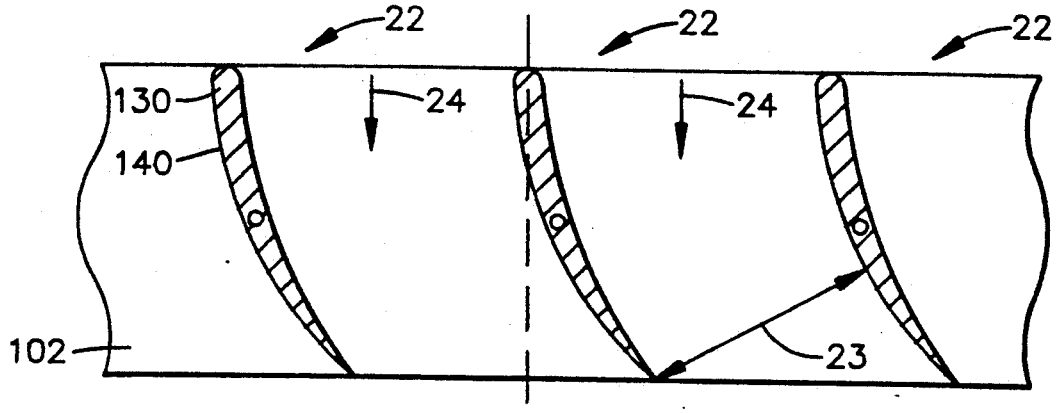
FIGS. 3A,3B, and 3C are schematic illustrations taken along lines 3—3 in FIG. 2 illustrating first and second vane panel positions corresponding to full power, reduced power, and no load operating modes, respectively.

For example, FIG. 3A schematically illustrates three adjacent and circumferentially spaced apart variable vane assemblies 22 as viewed along lines 3—3 in FIG. 2. In FIG. 3A, first and second independently variable vane panels 130 and 140 are aligned with respect to each other (so that panel 140 is not directly visible as viewed along lines 3—3 in FIG. 2) and with respect to booster inlet airflow 24 in an open baseline position for providing a maximum booster flow area 23 comprising radially outward booster flow area 23A and radially inward booster flow area 23B, thus providing maximum airflow 33. This position provides maximum booster flow area and maximum booster efficiency, and corresponds to a maximum power synchronous speed operation of power turbine 16 and maximum output shaft 52 horsepower, such as for generating electricity during peak demand periods.

Figure 3B:
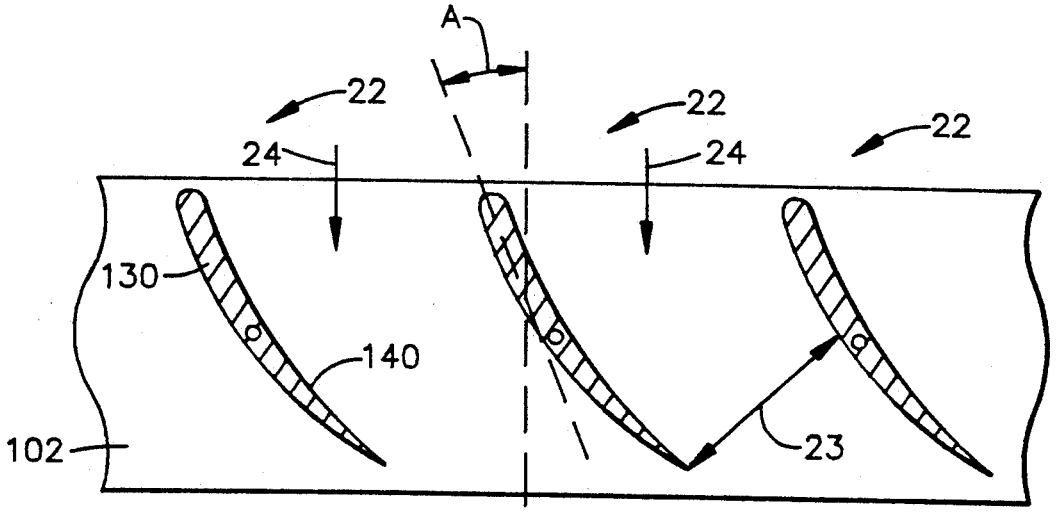

In FIG. 3B vane panels 130 and 140 are aligned with respect to each other to provide a relatively clean aerodynamic flow path, and are rotated to a partially closed position relative to the booster inlet flow 24 as indicated by angle A. Rotation of panels 130 and 140 reduces both radially outward booster flow area 23A and radially inward booster flow area 23B. This position thereby reduces total booster flow area 23 and booster airflow 24, as well as airflow 33. Reduced airflow 33 provides a reduced power synchronous speed operation of the power turbine 16 and reduced output shaft 52 horsepower. This position can be used for generating electricity during off peak demand periods, or for transitioning to the full power position of FIG. 3A from the minimum power synchronous operating position described below with respect to FIG. 3C, such as during lock-on to the power grid. The position shown in FIG. 3B can also be used to transition from the full power position of FIG. 3A to the position of FIG. 3C during lock-off from the power grid. Angle A is greater than zero, and can be varied up to about 40 degrees to 60 degrees depending upon the required output shaft 52 horsepower and the stall characteristics of the booster compressor 12.

Figure 3C:
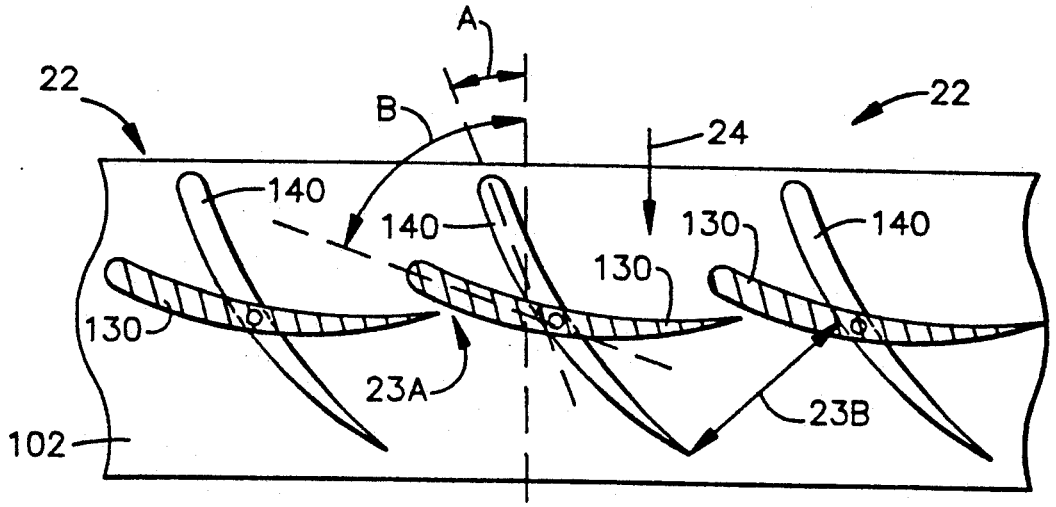

In FIG. 3C, first vane panel 130 is rotated independently of vane panel 140 to a substantially closed positions with respect to booster inlet flow 24, as indicated by angle B. Angle B can be selected to reduce radially outward booster flow area 23A to a substantially zero value, while panel 140 can be held in a partially closed position to provide a minimum total booster airflow area 23B and minimum booster airflow 24. Minimum booster airflow provides a minimum power synchronous speed operation of the power turbine 16, and therefore reduces available output shaft 52 horsepower. In addition, flow disturbances caused by the misalignment of the vane panels and the substantial closure of the outer vane panel will reduce the aerodynamic efficiency of booster compressor 12. Thus, a greater percentage of power turbine horsepower is consumed by booster compressor 12, and output shaft 52 horsepower is reduced. While such booster inefficiencies increase fuel consumption of engine 10, variable vane assembly 22 need only be operated in the position shown in FIG. 3C infrequently, and only for brief periods of time, such as for locking-on and locking off the power grid.

The position shown in FIG. 3C can also be used during emergency stopcock rollback (unfueled shutdown) of the engine 10. During such shutdowns, the power turbine 16 and booster 12 slow down slowly relative to the core engine due to the inertia of the generator 54. Booster stall can result where the relatively rapidly rotating booster 12 attempts to compress more airflow 33 than is required by the decelerating core engine. The variable vane assembly position shown in FIG. 3C not only reduces the booster flow 24 (and thus compressed airflow 33), but also creates the aerodynamic inefficiencies discussed above. These inefficiencies can act to brake the power turbine 12 by consuming (or wasting) power turbine horsepower and prevent booster stall.

The variable vane assembly 22 is preferably operable with bleed means 46 wherein bleed means 46 extracts a portion of the compressed booster airflow 33 when first panel 130 is rotated from the baseline position shown in FIG. 3A. Bleed means 46 can be varied from a closed position (shown in phantom in FIG. 2), when first and second vane panels 130 and 140 are in an aligned baseline position shown in FIG. 3A, to an open position shown in FIG. 2, when first and second vane panels 130 and 140 are rotated as shown in FIG. 3C. In particular, bleed means 46 can bleed, or extract, a radially outward distorted portion 33A of compressed booster airflow 33. For instance, rotation of first panel 130 to a substantially closed position as shown in FIG. 3C will result in a highly distorted flow characterized by wakes and vortices in radially outer booster flow area 23A downstream of first panel 130, which may stall or even damage the core engine if permitted to enter HPC 34. Bleed means 46 can be operable with first panel 130 by control means 50 to extract distorted portion 33A upstream of core engine 10 when first panel 130 is rotated from the baseline position shown in FIG. 3A, and in particular when first panel 130 is rotated to the substantially closed position shown in FIG. 3C, such as during low power lock-on or lock-off operations, or during an emergency stopcock rollback of engine 10. Opening of bleed means 46 extracts the distorted flow portion 33A and decreases the output shaft 52 horsepower by reducing the compressed flow delivered to core engine 14 to a radially inward portion 33B as shown in FIG. 2. Opening of bleed doors 46 also increases the booster stall margin by reducing the pressure downstream of booster compressor 12.

The table below shows calculated results providing an exemplary illustration of the advantageous reduction in output shaft 52 horsepower when variable vane assembly 22 is operated with bleed means 46 in engine 10 shown in FIG. 1 and 2.

TABLE I

| | A | B | C | D |
|---|---|---|---|---|
| SPEED | 3600 | 3600 | 3600 | 3600 |
| SHAFT HP | 55600 | 20000 | 8200 | 0 |
| VBV FLOW (LB/SEC) | CLOSED | CLOSED | 39 | 39 |
| OUTER PANEL CLOSURE (DEG.) | 0 | 40 | 40 | 80-90 |
| INNER PANEL CLOSURE (DEG) | 0 | 40 | 40 | 40 |
| CORE INLET FLOW (LB/SEC) | 260 | 145 | 106 | 66 |

In Table I, point A is a full power operation point with the VBVs 47 closed and vane panels 130,140 aligned in a baseline position as shown in FIG. 3A. Points B and C represent reduced power operating points. Point B represents operation with the VBV's closed and panels 130,140 aligned and rotated about 40 degrees from the baseline full power position. Point C is similar to point B, but with the VBV's open to further reduce core flow and output shaft HP. Point D represents a no-load synchronous speed operating point with the VBVs open and outer panel 130 rotated to a substantially closed position of about 80 to 90 degrees as shown in FIG. 3C to further reduce the core inlet flow and output shaft 52 HP. While four distinct operating points are shown, the transition from point A to point D may be accomplished by a number of combinations and variations of vane panel rotation and VBV closure.

To connect generator 54 to power grid 56, vane panels 130 and 140 can be set as in FIG. 3C and VBVs 47 can be fully opened. Fuel injection means 38 can provide increased fuel flow to combustor 36 to bring power turbine 16 and booster 12 up to synchronous speed for lock-on of generator 54 to power grid 56. Power turbine 16 can be operated at reduced power such as for off peak electricity demand by increasing fuel flow, and rotating the vane panels to the position shown in FIG. 3B. For full power operation such as for peak electricity demand the fuel flow can be further increased, the VBVs closed, and the vane panels rotated to the position shown in FIG. 3A.

To disconnect the generator 54 from the power grid 56, the fuel injection means 38 reduces fuel to the engine 10 for decreasing the horsepower from the output shaft 52, VBVs 47 can be fully opened, and vane panels 130 and 140 can be rotated together to the position shown in FIG. 3B, followed by further rotation of vane panel 130 to the substantially closed position shown in FIG. 3C. Conventional variable stator vanes 30 can be also be varied to increase the stall margin of the booster compressor during reduced power and no-load operation.

Emergency stopping of the engine 10 from full power operation is effected by cutting off all fuel to the engine 10 from the fuel injection means 38 (i.e. fuel stopcock), fully opening the VBVs 47 to prevent booster stall and to obtain maximum work from the booster 12 for braking of the power turbine 16, and rotating vane panels 130 and 140 to the position shown in FIG. 3C to provide further braking of the power turbine 16. In the stopcock rollback condition, stall of the HPC 34 may be further avoided by bleeding compressed air from the HPC 34 using the HPC bleed means 48 at various stages.

Control 50 can provide coordinated variation of assemblies 22, VBVs 47, and stator vanes 30 based on a predetermined schedule. For instance, the schedule can provide desired positioning of assemblies 22, VBVs 47, and vanes 30 based upon booster speed corrected for inlet flow 24 temperature, core engine speed corrected for compressed airflow 33 temperature, and measured output shaft horsepower.

Further variability and reduction in output shaft 52 horsepower may be provided by operating outlet flow varying means 68 in combination with variable vane assembly 22 and VBVs 47 by control means 50. In addition, in some applications a dual panel variable booster exit guide vane assembly 31 positioned downstream of the last row of rotating booster blades 28 may be desirable to prevent rotating stall in booster compressor 12. Closure of outer panels 130 of exit vane assembly 32 with panels 130 of inlet vane assembly 22 can increase the static pressure of the radially outer booster flow, and thus reduce tendency for radial flow along blades 28. Such radial flow could cause rotating stall of booster compressor 12, as will be understood by those skilled in the art.

Figure 4:
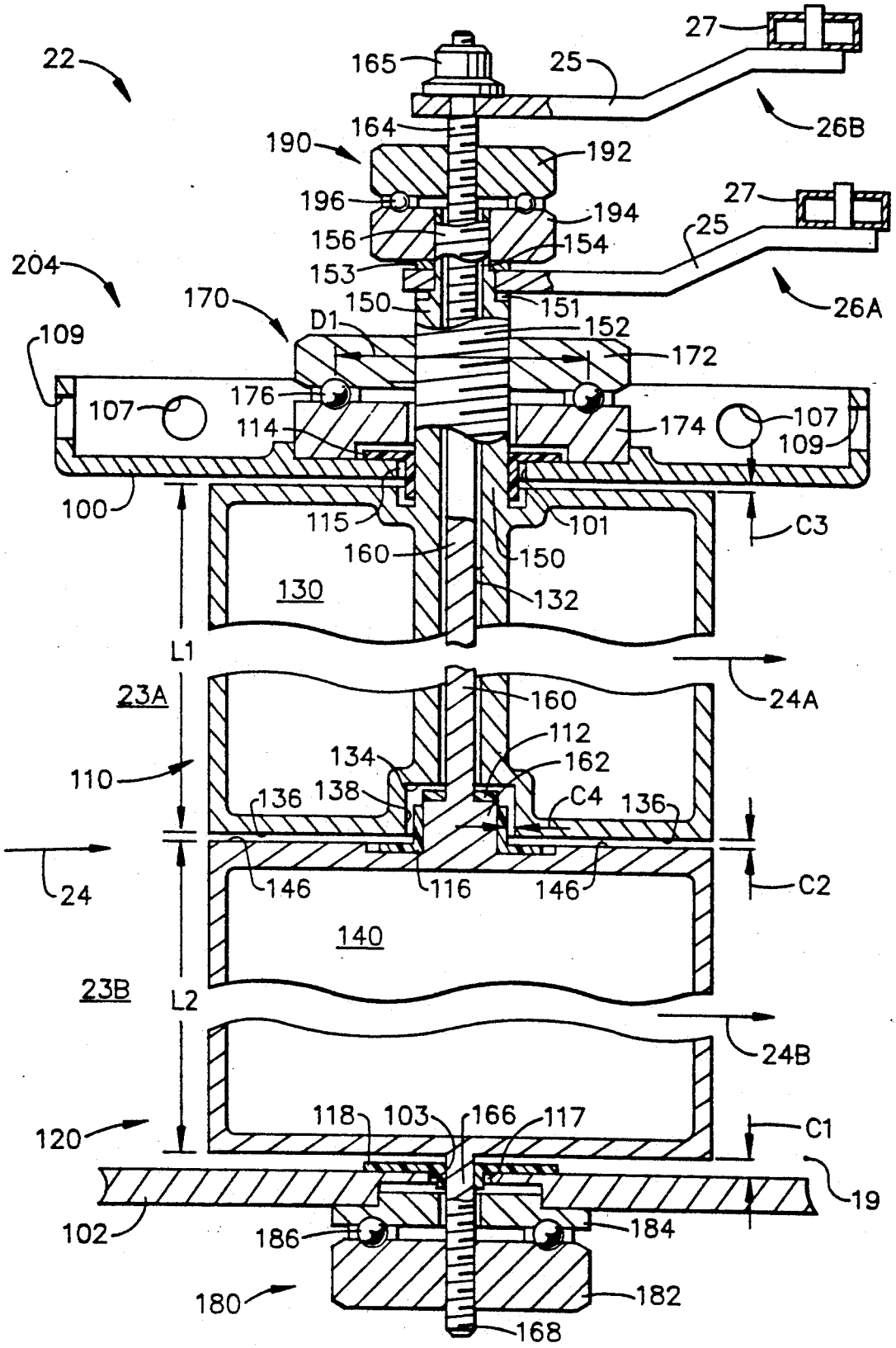
FIG. 4 is a cross-sectional illustration of a dual panel variable vane assembly in accordance with the present invention.
Figure 5:
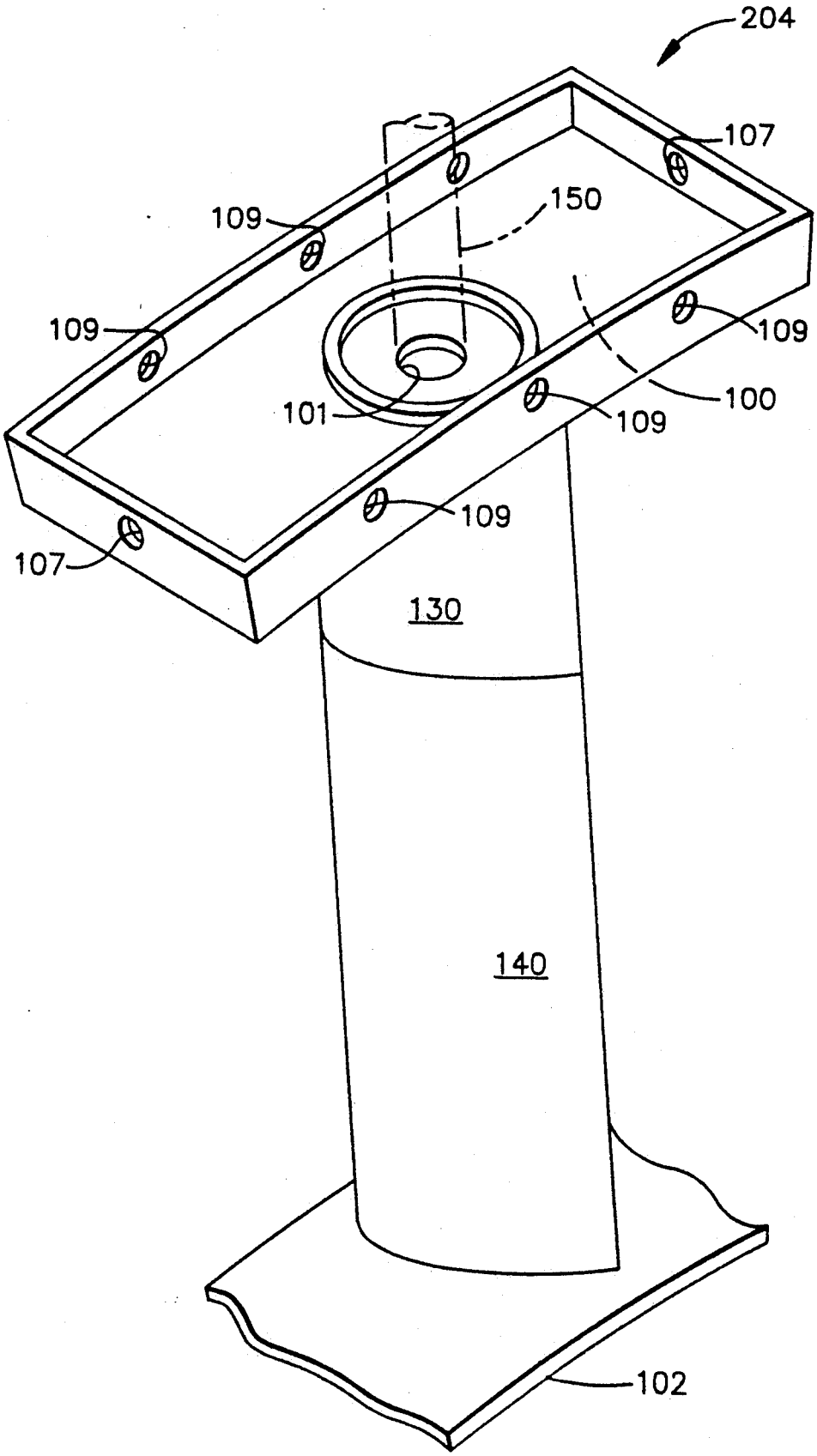
FIG. 5 is a perspective view of the variable vane assembly of FIG. 4 showing a segmented outer channel wall.

FIGS. 4 and 5 illustrate the booster inlet variable vane assembly 22 (or exit vane assembly 32) having first variable vane portion 110 and second variable vane portion 120 disposed within booster flow channel 19. First vane portion 110 includes first vane panel 130 disposed adjacent first channel wall 100 and a first shaft 150 which can extend from vane panel 130 radially outward through an aperture 101 in first outer channel wall 100. First shaft 150 can include a first threaded portion 152, a reduced diameter first shaft portion 154, and a second threaded portion 156 on reduced diameter first shaft portion 154. First vane portion 110 can include a radially extending cylindrical recess 138 having a radially inwardly facing surface 134.

Second vane portion 120 includes second vane panel 140 spaced from first channel wall 100 by first vane panel 130. A second shaft 160 can extend from vane panel 140 through a bore 132 in vane panel 130 to be coaxially disposed within first shaft 150. Second shaft 160 can include a base portion 162 extending into recess 138, and a threaded portion 164 extending radially outward beyond first shaft 150. Vane portion 120 can also include a third shaft 166 extending radially inward through an aperture 103 in second inner channel wall 102, the shaft 166 including a threaded portion 168. Vane portion 110 is rotatably supported outward of channel wall 100 by support means 170, with first vane panel 130 extending into the channel in a cantilevered manner. Vane portion 120 is rotatably supported radially outward of channel wall 100 by support means 190, and is supported radially inward of channel wall 102 by support means 180. The support means are more fully described below.

First varying means 26A and 26B can comprise a conventional unison ring 27 and a crank arm 25. A crank arm 25 can be keyed, slotted or otherwise attached to first shaft 150 for rotation of first vane panel 130, or similarly attached to second shaft 160 for rotation of second vane panel 140. The first and second varying means 26A and 26B are both disposed outward of first channel wall 100, thereby allowing for use of conventional unison rings 27 and crank arms 25, ease of access and assembly, and relatively low actuator component temperatures. U.S. Pat. No. 4,254,619 shows a variable inlet guide vane with inner and outer portions variable by inner and outer controls positioned on inner and outer cases, requiring routing of hydraulic or other actuating lines to actuators on both cases. Temperatures in the interior of the engine may be hotter than those outward of outer channel wall 100 and may adversely affect actuator component life.

For ease of assembly, the outer channel wall 100 can be formed in a plurality of circumferentially adjacent case segments 204, as shown in FIG. 5. Each segment 204 can include an aperture 101, bolt holes 109 for connection to axially adjacent upstream and downstream case portions 202 and 206 (FIG. 2), and bolt holes 107 for connection to adjacent segments 204. Support and installation of an assembly 22 is described below:

Flanged bushing 118 (FIG. 4), which can have a glass fiber polyaide (gfp) composition, is positioned on third shaft 166, and shaft 166 is inserted through aperture 103 in channel wall 102. Bushing 118 reduces leakage through channel wall 102, and is loosely fit in aperture 103 to form clearance 117. Thus, bushing 118 acts only as a seal. Bushing 118 transmits no loads between shaft 166 and channel wall 102, thereby enhancing bushing life.

Next, support means 180 is installed. Support means 180 includes spacer 184 slidably disposed on shaft 166, self locking nut 182, and ball bearing means 186 disposed between nut 182 and spacer 184 to permit relative rotation therebetween. Nut 182 and spacer 184 can form the inner and outer races for ball bearing means 186 as shown in FIG. 4. Alternatively, ball bearing means 186 could comprise a ball and race assembly. Nut 182 engages threaded portion 168, and is advanced to set a predetermined radial clearance C1 between vane panel 140 and channel wall 102 for low aerodynamic losses between panel 140 and wall 102. Bearing means 186 rotatably supports shaft 166 with respect to channel wall 102. Bushing 118 can be sized with a thickness smaller than C1 to reduce leakage between panel 140 and channel wall 102.

Flanged bushing 116 and washer 112, which can have a gfp composition, are next positioned on base portion 162 of second vane portion 120. First vane portion 110 is then positioned on second shaft 160 so that shaft 160 extends through bore 132 and threaded portion 164 extends outward of threaded portion 156. A segment 204 with aperture 101 is positioned on first shaft 150 with shaft 150 extending through aperture 101. Segment 204 can then be bolted to downstream case portion 206, as well as to any adjacent segments 204.

Flanged bushing 114, which can have a gfp composition, is next positioned on shaft 150 in aperture 101. Bushing 114 reduces leakage through channel wall 100, and is loosely fit in aperture 101 to form clearance 115. Thus, bushing 114 acts only as a seal, and transmits no loads for enhanced bushing life.

Support means 170 is next installed and includes spacer 174 slidably disposed on shaft 150, self locking nut 172, and ball bearing means 176 disposed between nut 172 and spacer 174 to permit relative rotation therebetween. Nut 172 and spacer 174 can form the inner and outer races for ball bearing means 176 as shown in FIG. 4. Alternatively, ball bearing means 176 could comprise a ball and race assembly. Nut 172 engages threaded portion 152, and is advanced on shaft 150 to set a predetermined radial clearance C2 between panel 130 and 140. Clearance C3 between panel 130 and channel wall 100 is also set by nut 172.

Bearing means 176 rotatably supports shaft 150 with respect to channel wall 100 such that vane panel 130 extends into the channel in a cantilevered manner. By cantilevering of panel 130 it is meant that vane panel 130 is supported only through shaft 150 at the radially outer end of panel 130. Surfaces 134, 136 and 138 of the radially inner end of panel 130 do not contact or transmit loads to panel 140 under normal operating conditions. Radially inner end surface 136 on panel 130 is spaced from radially outer end surface 146 on panel 140 by radial clearance C2.

Recess 138 is oversized to provide lateral clearance C4 between the surface of recess 138 and flanged bushing 116, as well as a radial clearance between washer 112 and surface 134 during normal operating conditions. Thus, washer 112 and bushing 116 are sized with recess 138 to not transmit loads between vane portions 110 and 120 during normal operating conditions, and therefore will have low wear and require little maintenance. Washer 112 and bushing 116 can reduce leakage between the vane portions and prevent metal-to-metal contact between the vane portions when panel 130 is subject to high aero side loading. Alternatively, surface 134 could be supported on base 162 by washer 112.

Bearing washer 151, crank arm 25 of varying means 26A, and spacing washer 153 are positioned on shaft 150. Support means 190 is next installed, including self locking nut 194, self locking vane seating nut 192, and bearing means 196 disposed therebetween. Nut 194 is advanced on threaded portion 156 to seat crank arm 25 on shaft 150. Nut 192 is then advanced on threaded portion 164 of shaft 160, and with ball bearing means 196 and nut 194 rotatably supports shaft 160 on shaft 150 and prevents radial motion of shaft 160 with respect to shaft 150. Crank arm 25 of varying means 26B is then positioned on 160 and seated by nut 165.

When all vane assemblies 22 and case segments 204 have been installed, upstream case portion 202, which can comprise the engine inlet, can be bolted to segments 204. Upstream and downstream case portions 202 and 206 may comprise a plurality of arcuate segments, such as two 180 degree case sectors.

Support means 170, 180, and 190 radially fix vane portions 110 and 120 with respect to each other and channel walls 100 and 102 while permitting relative rotation, and thereby maintain radial clearances C1, C2 and C3. Aero loads on panel 130 are reacted at support means 170. Aero loads on panel 140 are reacted in part at support means 180, and in part at support means 190. Thus, loads transmitted between vane portions 110 and 120 are transmitted at support means 190, and not at the juncture of vane panels 130 and 140, thereby promoting long life for bushing 116 and washer 112.

Support of vane panel 130 in a cantilevered manner also permits close radial spacing of panel 130 with respect to panel 140 to minimize airflow distortion losses at the juncture of the first and second vane panels when the vane panels are aligned as in FIGS. 3A and 3B. Thus, minimal distorted flow enters core engine 14 at full and part power operation. U.S. Pat. No. 4,254,619 shows an annular ring between inner and outer portions which can distort airflow. Such an annular ring, if positioned in booster channel 19, would distort core flow at all operating points.

In the embodiment shown, outer panel 130 is cantilevered and vane panel 140 is supported at support means 180 and 190. Other embodiments could include a cantilevered inner panel. One reason for cantilivering outer panel 130 is that the moment required to support a distributed aerodynamic load along a cantilevered span varies with the square of the span, and the deflection at the cantilevered end varies with the fourth power of the span. Radial span L1 (not to scale in FIG. 4) of panel 130 is sized based on the fraction of inlet area 23 (and flow 24) that must be blocked by vane panel 130 to obtain no-load synchronous speed operation. L1 will generally be much less than span L2 of panel 140. For instance, in an exemplary engine 10 having inlet area 23 of 1200 square inches with a 27 inch outer radius, inner panel 140 allows 105 lb/sec flow and panel 130 blocks 40 lb/sec to achieve no-load synchronous speed operation, so that L1 is about 2 inches and L2 is about 6.3 inches. Therefore, it can be advantageous to cantilever the shorter of panels 130 and 140 to reduce the bending moments reacted at the support means and to reduce the lateral deflections of the panels. In addition, diameter D1 of bearing means 176 can be sized to react the overturning moment generated by aerodynamic loads on cantilevered vane panel 130 and to minimize lateral deflections of the radially inner end of panel 130 caused by bearing 176 tolerances and clearances.

While the preferred embodiments of the present invention have been described, other modifications shall be apparent to those skilled in the art from the teachings herein. For instance, while the preferred embodiment has been shown in a dual rotor gas turbine engine, it may be adapted to other engines including single or triple rotor engines with power turbines driving both a compressor and an output shaft. Accordingly, what is desired to be secured by Letters Patent of the United States is the invention as defined and differentiated in the following claims:

I claim:

1. A variable vane assembly in a gas turbine engine for regulating flow in a channel, comprising:

(a) a first variable vane portion having a first vane panel disposed within said channel adjacent a first channel wall;

(b) a second variable vane portion having a second vane panel disposed radially inward of said first panel within said channel and spaced from said first channel wall by said first vane panel;

(c) means for independently varying said first and second vane portions, said varying means being disposed radially outward of said first channel wall;

(d) a first shaft extending from said first vane panel;

(e) a second shaft extending from said second vane panel and disposed coaxially within said first shaft, wherein said first and second shafts are independently rotatable by said varying means;

(f) means for rotatably supporting said first shaft wherein said first vane panel extends into said channel in a cantilevered manner; and (g) means for rotatably supporting said second shaft and said second vane portion on said first shaft and said first vane portion.

2. The vane assembly recited in claim 1, wherein said first vane panel is spaced from said second vane panel by a radial clearance to reduce aerodynamic losses at a juncture of said first and second vane panels.

3. The vane assembly recited in claim 1, further comprising means for rotatably supporting said second variable vane portion with respect to a second channel wall.

4. The vane assembly recited in claim 1, further comprising:

(a) means for spacing said second vane portion from said second channel wall by a radial clearance; and (b) means for spacing said first vane panel from said second vane panel by a radial clearance.

5. The vane assembly recited in claim 3, further comprising:

(a) a first shaft extending through said first channel wall, said first shaft including a first threaded portion and a second threaded portion;

(b) a second shaft extending through said first vane panel and disposed coaxially within said first shaft for independent rotation with respect to said first shaft, said second shaft including a threaded portion extending outward of said first shaft threaded portions;

(c) a third shaft extending through said second channel wall, said third shaft including a threaded portion;

(d) means for engaging said third shaft threaded portion for setting a clearance between said second vane panel and said second channel wall, said third shaft engaging means including bearing means for rotatably supporting said third shaft with respect to said second channel wall;

(e) means for engaging said first threaded portion on said first shaft for setting a radial clearance between said first vane panel and said second vane panel, said first shaft engaging means including bearing means for rotatably supporting said first shaft with respect to said first channel wall; and (f) means for engaging said second shaft threaded portion and said second threaded portion on said first shaft, said second shaft engaging means including bearing means for rotatably supporting said second shaft on said first shaft.

6. The vane panel recited in claim 5, further comprising:

(a) bushing means disposed on said first shaft and loosely fit in a first channel wall aperture for reducing leakage through said first channel wall; and (b) bushing means disposed on said third shaft and loosely fit in a second channel wall aperture for reducing leakage through said second channel wall.

* * * * *